US005836516A

United States Patent [19]

Van Epps et al.

[11] Patent Number: 5,836,516

[45] Date of Patent: Nov. 17, 1998

[54] FOLDABLE, PORTABLE SPRINKLER SYSTEM

[75] Inventors: Lynn F. Van Epps; James L. Van Epps, II, both of Portage, Wis.

[73] Assignee: Freeland Industries, Inc., Portage, Wis.

[21] Appl. No.: 772,809

[22] Filed: Dec. 24, 1996

[51] Int. Cl.[6] ..... B05B 15/06; A62C 13/76

[52] U.S. Cl. ..... 239/280.5; 239/273; 239/280; 239/281; 248/76; 248/85

[58] Field of Search ..... 239/273, 275, 239/279, 280, 280.5, 281; 248/76, 85, 86, 87, 88, 169, 171

[56] References Cited

U.S. PATENT DOCUMENTS

| | | | |
|---|---|---|---|
| 1,064,798 | 6/1913 | Walte | 248/171 |
| 1,187,349 | 6/1916 | Libby | 239/281 |
| 1,959,886 | 5/1934 | Wadsworth | 239/280.5 |
| 2,493,978 | 1/1950 | Kromer | 248/169 X |
| 2,694,600 | 11/1954 | Richey | 239/280 X |
| 3,915,382 | 10/1975 | Davis | 239/281 X |
| 4,813,638 | 3/1989 | Garcia | 248/169 X |
| 5,337,960 | 8/1994 | Allen | 239/280.5 |

*Primary Examiner*—Andres Kashnikow
*Assistant Examiner*—Robin G. Evans
*Attorney, Agent, or Firm*—Ezra Sutton

[57] ABSTRACT

A portable water sprinkler system including a central water column assembly having a lower section, an upper section removably connected to the lower section, and a sprinkler head removably connected to the upper section. The lower section includes an outer tube formed of galvanized steel, an inner tube formed of plastic for supplying water to the upper section, and a hose connector at the lower end for receiving a hose for supplying water to the inner tube. The upper section is formed of plastic and is removably connected to the inner tube of the lower section. The outer tube of the lower section includes three connection flanges formed of galvanized steel extending outwardly from the outer tube. The portable water sprinkler system further includes first, second, and third leg members formed of galvanized steel being pivotally connected at their upper ends to the three connection flanges on the outer tube, respectively. In addition, the portable water sprinkler system includes first, second, and third horizontally disposed feet members for engaging the ground to support the sprinkler system and being connected to the lower ends of the first, second, and third leg members, respectively. The lower section further includes a second outer tube formed of galvanized steel that is slidably disposed on the inner tube. Further, the second outer tube includes three connection flanges extending outwardly from the second outer tube.

4 Claims, 5 Drawing Sheets

FOLDABLE, PORTABLE SPRINKLER SYSTEM

FIELD OF THE INVENTION

This invention relates to a foldable, portable sprinkler system for water spraying of lawns, gardens, flowers, shrubs, orchards, and trees. More particularly, this invention relates to a sprinkler system for irrigation purposes of lightweight design for easy setup and being foldable into a compact, lightweight configuration for easy storage and carrying by the user.

BACKGROUND OF THE PRESENT INVENTION

Various sprinklers and sprinkler systems for use in residential, commercial and agricultural irrigation have long been in use. Elevated sprinkler systems are especially useful as they can spray water over large areas, onto and over crops, small trees (i.e. orange, apple and banana), bushes, shrubs, and the like.

Present day elevated sprinkler systems are of heavy construction, awkward in structure and design, not suitable for moving easily into desired positions and not easily carried from watering point to watering point. In addition, when the elevated sprinkler systems are in operational use, there is a tendency of the sprinkler system to overturn and fall on to the ground due to high water pressure within the water column and sprinkler head, such that the reaction forces of the water coming-out the sprinkler head make the sprinkler system unstable regardless of the type of base-stand the sprinkler system incorporates in its design.

There remains a need for a collapsible, foldable and portable water sprinkler system that is lightweight, easily installed, and compact in configuration for ease of carrying and storage. In addition, the water sprinkler system will not be subject to overturning when in operational use.

DESCRIPTION OF THE PRIOR ART

Water sprinkler systems of various designs, structure, configurations and materials of construction have been disclosed in the prior art. For example, U.S. Pat. No. 1,959,886 to Wadsworth discloses a portable sprinkler support that has a tripod supporting ring having non-extendable bamboo legs for use in watering and spraying of fruit trees. The water is passed through a central non-extendable pipe and a sprinkler head. This prior art patent does not disclose the particular structure and design of the water sprinkler system of the present invention.

U.S. Pat. No. 2,694,600 to Richey discloses a lawn sprinkler stand having a C-shaped configuration base supported by a tripod collar having braces that are non-extendable and connected to the C-shaped base. The water is passed through a central extendable pipe and a sprinkler head. This prior art patent does not disclose the particular structure and design of the water sprinkler system of the present invention.

U.S. Pat. No. 4,824,020 to Harward discloses a sprinkler stand having a central support hub with a plurality of at least five non-extendable legs, and the water is passed through a short central pipe and a sprinkler head. This prior art patent does not disclose the particular structure and design of the water sprinkler system of the present invention.

U.S. Pat. No. 5,439,176 to Bussiere discloses a lawn-garden sprinkler having a tripod support structure. The tripod support structure includes a spindle axis having non-extendable support rods which radiate outwardly from the central axis being connected to tie rods. The tie rods are welded to the support rods to provide a rigid tripod construction resistant to fracture or bending forces. The water passes through a short angled pipe and a sprinkler head. This prior art patent does not disclose the particular structure and design of the water sprinkler system of the present invention.

None of the prior art water sprinkler systems disclose the structure, configuration and functionality of the present invention.

Accordingly, it is an object of the present invention to provide a sprinkler system of simple design, durability and sturdiness having a tripod assembly with feet for increased ground stability; and a central water column assembly being rotatable relative to the tripod assembly for ease of water hose connecting and orientation.

Another object of the present invention is to provide a sprinkler system which has a structure and design configuration that substantially eliminates the "kick" or reaction forces resulting from water being ejected from the sprinkler head, such that the sprinkler system is not subject to being overturned by the reaction forces of the water.

Another object of the present invention is to provide a sprinkler system that has substantially eliminated the "kick" being transmitted to the tripod assembly by allowing the central water column assembly to be rotationally movable relative to the tripod assembly in order to prevent any overturning of the sprinkler system when in use.

Another object of the present invention is to provide a sprinkler system that is of lightweight design and simple structural configuration for easy setup for water spraying of lawns, gardens, flowers, shrubs, orchards, and trees.

Another object of the present invention is to provide a sprinkler system that is foldable into a compact, lightweight and portable configuration for easy carrying and storage by the user without removing any bolts or nuts.

Another object of the present invention is to provide a sprinkler system made of galvanized steel and PVC plastic components for increased operational use and service life of the sprinkler system without undue maintenance and operational costs.

Another object of the present invention is to provide a sprinkler system that is capable of water spraying an area that covers up to 5,000 square feet.

A further object of the present invention is to provide a water sprinkler system that can be mass produced in an automated and economical manner and is readily affordable by the user.

SUMMARY OF THE INVENTION

In accordance with the present invention, there is provided an improved portable water sprinkler system, including a central water column assembly having a lower section, an upper section removably connected to the lower section, and a sprinkler head removably connected to the upper section. The lower section includes an outer tube formed of galvanized steel, an inner tube formed of plastic for supplying water to the upper section, and a hose connector at the lower end for receiving a hose for supplying water to the inner tube. The upper section is formed of plastic and is removably connected to the inner plastic tube of the lower section. Further, the upper section includes a connecting collar for removably connecting the sprinkler head thereto. The outer tube of the lower section includes three spaced-apart connection flanges formed of galvanized steel extending outwardly from the outer tube. The portable water sprinkler system further includes first, second, and third leg members formed of galvanized steel being pivotally connected at their upper ends to the three connection flanges on the outer tube, respectively. In addition, the portable water sprinkler system includes first, second, and third horizontally disposed feet members for engaging the ground to support the water sprinkler system and being connected to the lower ends of the first, second, and third leg members, respectively. The lower section further includes a second outer tube formed of galvanized steel that is slidably disposed on the inner tube. Further, the second outer tube includes three connection flanges extending outwardly from the second outer tube. The portable water sprinkler system further includes fourth, fifth, and sixth leg members formed of galvanized steel being pivotally connected at their upper ends to the three connection flanges on the second outer tube, respectively. The first, second, and third feet members are connected to the lower ends of the fourth, fifth, and sixth leg members, respectively. The first to sixth leg members are movable between a first position parallel to the central water column assembly when the sprinkler system is not in use and a second position diagonally disposed relative to the central water column assembly when the sprinkler system is in use to support the central water column assembly in a vertical position.

BRIEF DESCRIPTION OF THE DRAWINGS

Further objects, features, and advantages of the present invention will become apparent upon consideration of the detailed description of the presently-preferred embodiments, when taken in conjunction with the accompanying drawings wherein.

DETAILED DESCRIPTION OF THE PREFERRED EMBODIMENT

Figure 1:
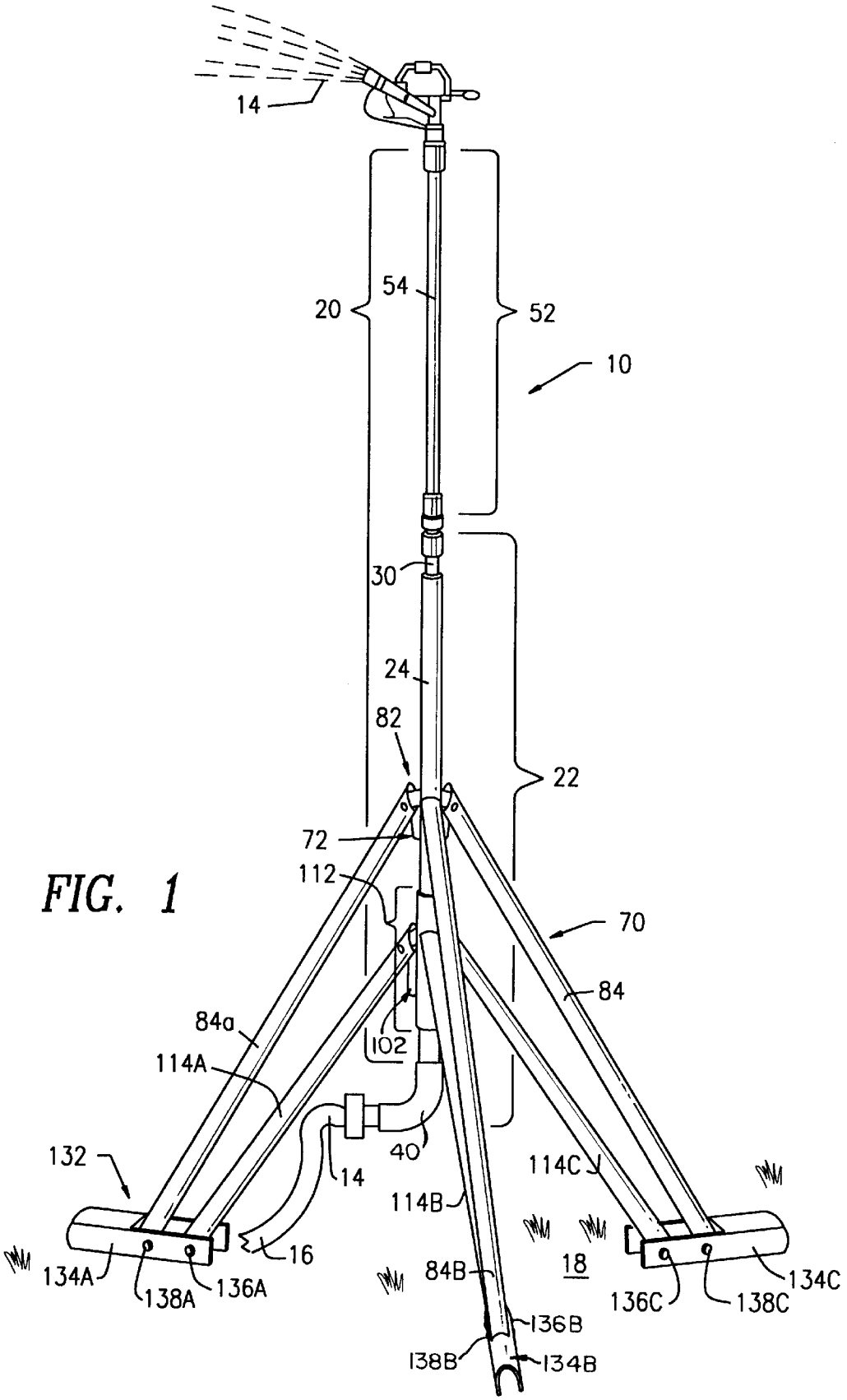
FIG. 1 is perspective view of the portable sprinkler system of the preferred embodiment of the present invention showing the major component parts contained therein and in operational use.
Figure 2:
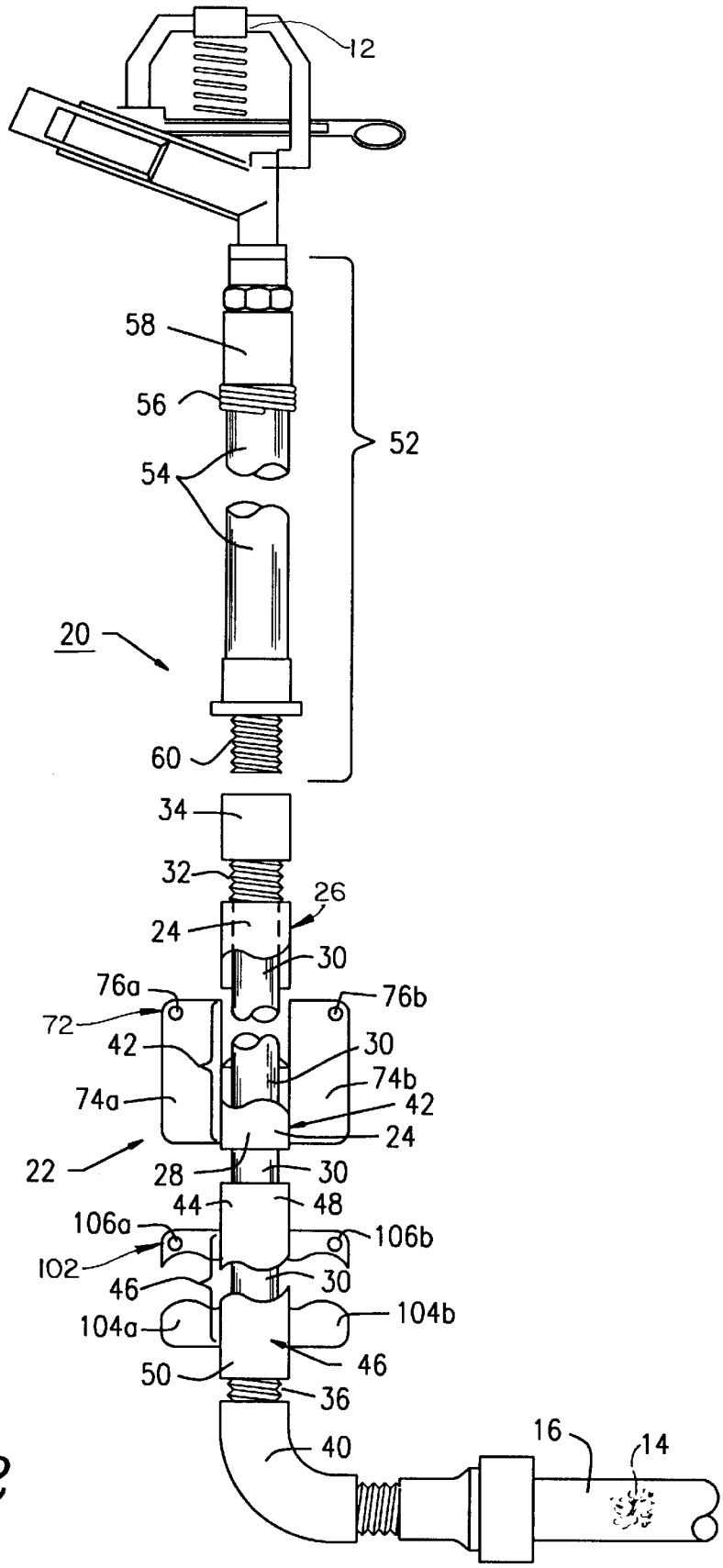
FIG. 2 is cross-sectional exploded view of the portable sprinkler system of the present invention showing the central water column assembly and its component parts contained therein.
Figure 3:
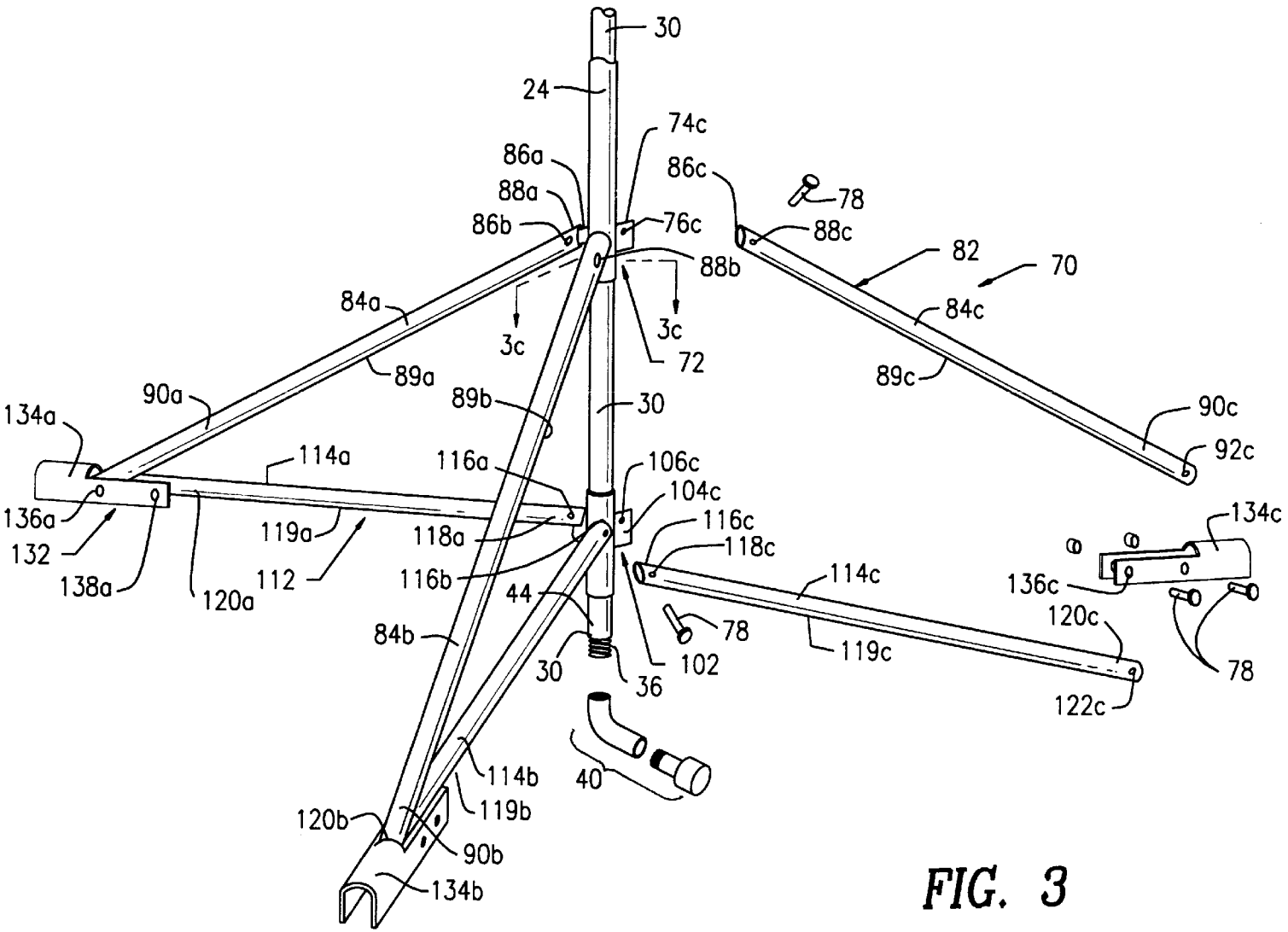
FIG. 3 is a partially exploded perspective view of the portable sprinkler system of the present invention showing the tripod assembly and its component parts contained therein.
Figure 3A:
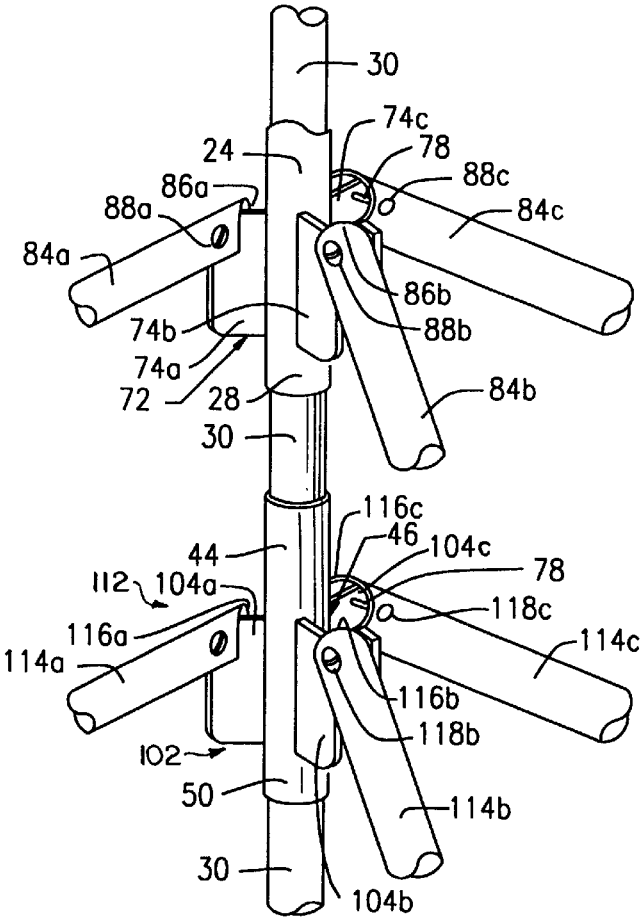
FIG. 3A is an enlarged perspective view of the portable sprinkler system of the present invention showing the first flange sub-assembly and the upper leg member sub-assembly being connected to the first outer tube; and showing the second flange sub-assembly and the lower leg member sub-assembly being connected to the second outer tube.
Figure 3C:
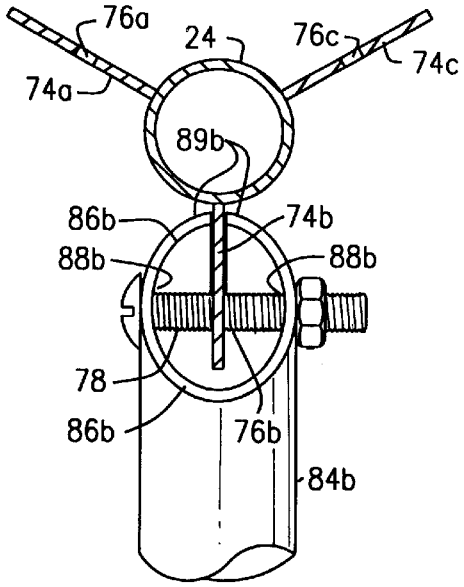
FIG. 3C is a cross-sectional perspective view of the portable sprinkler system taken along lines 3C—3C of FIG. 3 of the present invention showing the attachment of the upper leg member to the first flange assembly by a nut and bolt.
Figure 3B:
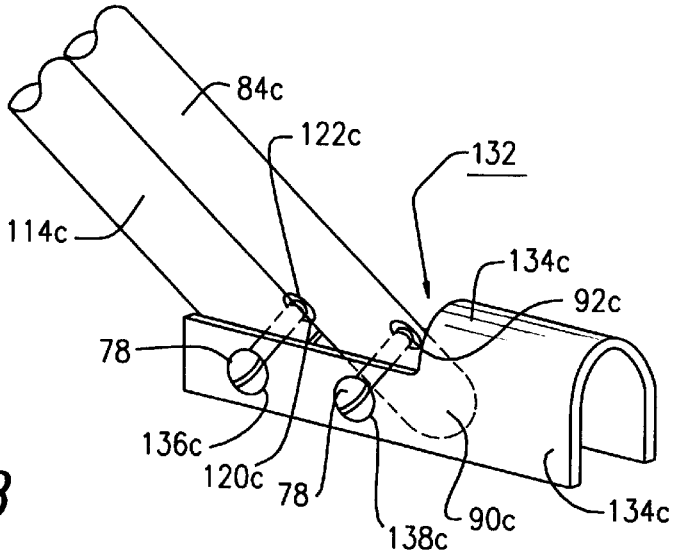
FIG. 3B is enlarged perspective view of the portable sprinkler system of the present invention showing the upper and lower leg member assemblies being connected to the foot member sub-assembly.
Figure 4:
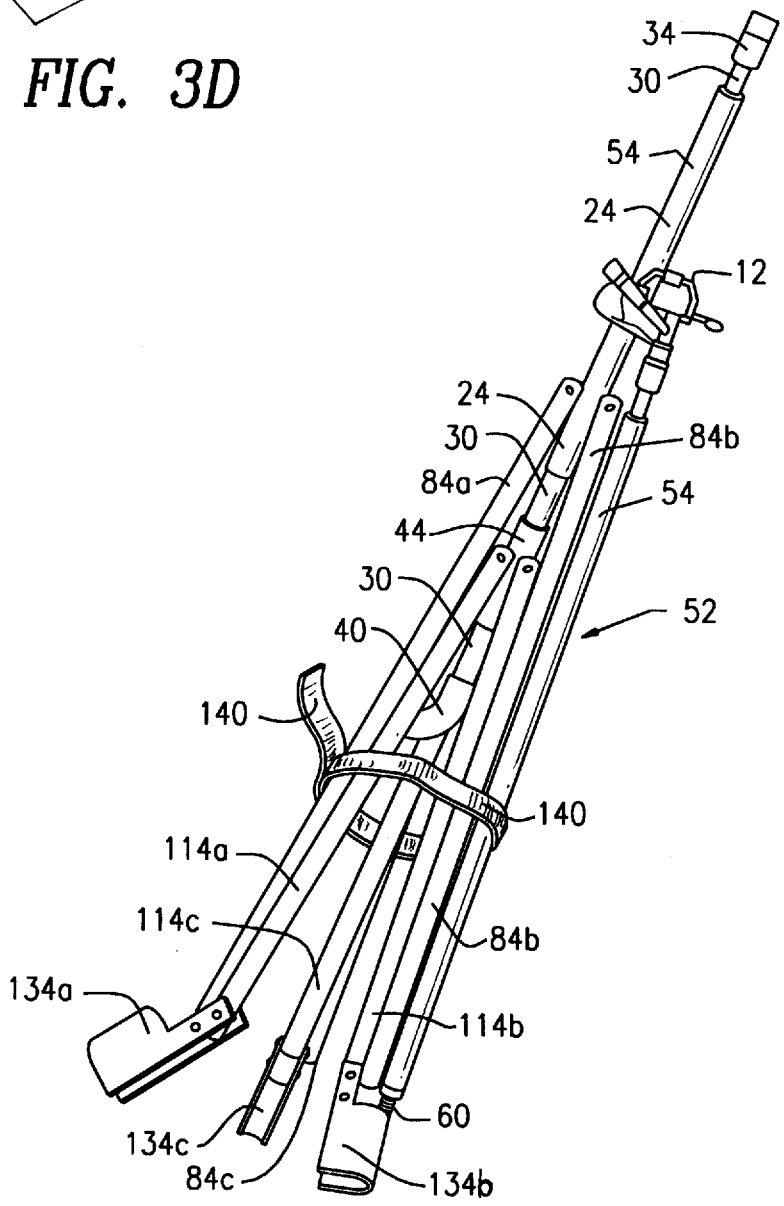
FIG. 4 is a perspective view of the portable sprinkler system of the present invention showing its upper and lower leg members in a folded-up and closed position, and ready for transport.

The foldable, portable water sprinkler system 10 of the preferred embodiment of the present invention is represented in detail in FIGS. 1, 2, 3, 3A, 3B and 4. FIG. 1 shows the water sprinkler system 10 fully assembled and in operational use. FIG. 2, 3, 3A and 3B show the major component assemblies and sub-assemblies contained therein. FIG. 4 shows the water sprinkler system in a collapsed state and in a non-operational position.

The water sprinkler system 10, as shown in FIG. 1, includes a sprinkler head 12 for dispensing and spraying water 14 on a lawn 18, a central water column assembly 20 for transferring water 14 from a hose 16 connected to a water source (not shown) via a plastic hose connection means 40, and a tripod assembly 70 for engaging the ground on which to support the sprinkler system 10 when in use.

The central water column assembly 20 includes a lower section 22 and a detachable upper section 52. The lower section 22 includes a first outer tube 24 formed of galvanized steel having an upper end 26 and a lower end 28; and an inner tube 30 formed of plastic PVC having an upper threaded end 32 with a threaded plastic PVC collar 34 and a lower threaded end 36 being connected to a plastic PVC hose connection means 40 for receiving a water hose 16 in which to supply water 14. The first outer tube 24 at the lower end 28 includes a first connection area 42 for connection to the upper leg member sub-assembly 82 of tripod assembly 70. The central water column assembly 20 further includes a second outer tube 44 formed of galvanized steel and being slidably disposed on the inner tube 30 and forming a second connection area 46. The second outer tube 44 has an upper end 48 and a lower end 50, such that the lower end 50 having the second connection area 46 thereon is used for connection to the lower leg member sub-assembly 112 of tripod assembly 70.

The upper section 52 includes a plastic PVC tube 54 having an upper threaded end 56 with a plastic threaded collar 58 for connection to the sprinkler head 12; and a lower threaded end 60 being connected to the threaded plastic collar 34.

The tripod assembly 70 includes a first flange sub-assembly 72, an upper leg member sub-assembly 82, a second flange sub-assembly 102, a lower leg member sub-assembly 112 and a foot member sub-assembly 132 in which to provide proper ground stability for the water sprinkler system 10 when in operational use.

The first flange sub-assembly 72 includes three (3) connection flanges 74*a*, 74*b*, and 74*c* having flange-leg connecting hole openings 76*a*, 76*b* and 76*c* and being connected to the first outer tube 24 at the lower end 28. The first flange sub-assembly 72 is for connecting to the upper leg member sub-assembly 82. The upper leg member sub-assembly 82 includes first, second and third leg members 84*a*, 84*b* and 84*c* each formed of open-seamed galvanized steel tubing and each having an open seam 89*a*, 89*b* and 89*c*, formed therein, respectively, as shown in FIGS. 3 and 3D. Each leg member 84*a*, 84*b* and 84*c* has an open seam 89*a*, 89*b*, and 89*c* extending the entire length of the leg members 84*a*, 84*b* and 84*c* for receiving therein connection flange 74*a*, 74*b*, and 74*c*, respectively. Each leg member 84*a*, 84*b*, and 84*c* includes an upper slanted end 86*a*, 86*b* and 86*c* with a connecting hole opening 88*a*, 88*b* and 88*c* formed therein, respectively; and each having a lower end 90*a*, 90*b* and 90*c* with a connecting hole opening 92*a*, 92*b* and 92*c* formed therein, respectively. In the assembled state, each hole opening 88*a*, 88*b* and 88*c* of upper leg member 84*a*, 84*b* and 84*c*, respectively, is connected to each flange hole opening 76*a*, 76*b* and 76*c* of connection flanges 74*a*, 74*b* and 74*c*, respectively, via connecting bolts 78, as shown in FIGS. 1 and 3A of the drawings.

The second flange sub-assembly 102 includes three (3) connection flanges 104*a*, 104*b* and 104*c* having flange-leg connecting hole openings 106*a*, 106*b*, and 106*c* and being connected to the second outer tube 44 at the lower end 50. The second sub-assembly 102 is for connecting to the lower leg member sub-assembly 112. The lower leg member sub-assembly 112 includes first, second and third leg members 114*a*, 114*b* and 114*c* each formed of open-seamed galvanized steel tubing having an open seam and each having an upper slanted ends 116*a*, 116*b*, and 116*c* with a connecting hole opening 118*a*, 118*b* and 118*c* formed therein, respectively; and each having a lower end 120*a*, 120*b*, and 120*c* with a connecting hole opening 122*a*, 122*b* and 122 formed therein, respectively. Each leg member 114*a*, 114*b*, and 114 has an open seam 119*a*, 119*b*, and 119*c* for receiving therein connection flange 104*a*, 104*b*, and 104*c*, respectively. In the assembled state, each hole opening 118*a*, 118*b* and 118*c* of lower leg member 114*a*, 114*b* and 114*c*, respectively, is connected to each flange hole opening 106*a*, 106*b* and 106*c* of connection flanges 104*a*, 104*b* and 104*c*, respectively, via connection bolts 78, as shown in FIGS. 1 and 3A of the drawings.

Figure 3D:
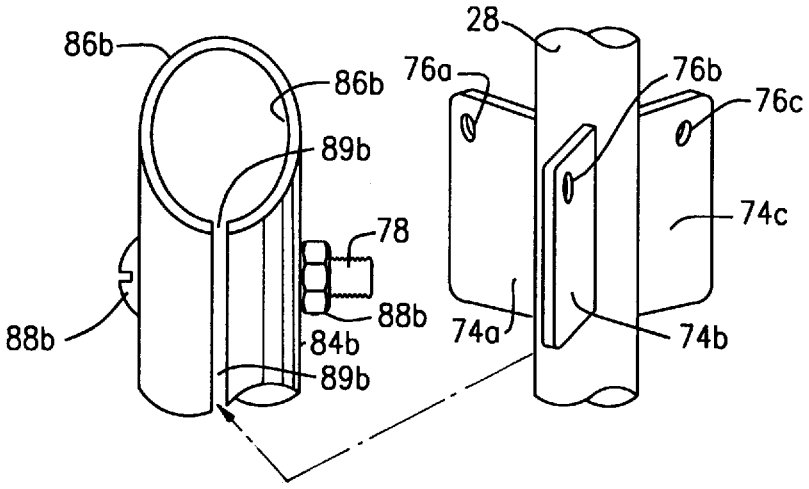
FIG. 3D is an enlarged view of the open seamed leg member receiving the flange.

The foot member sub-assembly 132 includes first, second and third foot members 134*a*, 134*b* and 134*c* being horizontally disposed on the ground when in the assembled state and in operational use, as shown in FIGS. 1 and 3B of the drawings. Each foot member 134*a*, 134*b* and 134*c* further includes two sets of connecting hole openings. The first connecting hole openings 136*a*, 136*b* and 136*c* of each foot member 134*a* to 134*c*, respectively connect to the hole openings 122*a* to 122*c* of each lower leg member 114*a* to 114*c*, respectively, via connecting bolts 78. The second connecting hole openings 138*a*, 138*b* and 138*c* of each foot member 134*a* to 134*c*, respectively, connect to the hole openings 92*a* to 92*c* of each upper leg member 84*a* to 84*c*, respectively, via connecting bolts 78. The connecting of each foot member 134*a* to 134*c* at the lower ends 120*a* to 120*c* and 90*a* to 90*c* of the lower and upper leg members 114*a* to 114*c* and 84*a* to 84*c* insures a horizontally disposed foot member 134*a* to 134*c* when placed on the ground, in the assembled state.

OPERATION OF THE PRESENT INVENTION

In operation the collapsible and foldable water sprinkler system 10 is partially assembled and readily put into operational use from a collapsed mode, as shown in FIG. 4 of the drawings, by simply matching and attaching the second hole openings 138*a* to 138*c* of foot members 134*a* to 134*c* with that of the connecting hole openings 92*a* to 92*c* of upper leg members 84*a* to 84*c*, respectively, via connecting bolts 78, as the lower leg members 114*a*, 114*b* and 114*c* are already assembled. This step opens the tripod assembly 70 to its fully open position such that each foot member 134*a* to 134*c* is horizontally disposed for engaging the ground 18 so as to support the sprinkler system 10 in a stable position. The user then attaches the plastic PVC tube 54 of the upper section 52 by inserting the lower threaded end 60 into the threaded plastic collar 34 of inner plastic PVC tube 30. Next, the user then rotates the hose connection means 40 of the water sprinkler system 10 towards the water source (not shown) and connects the water hose 16 to the plastic hose connection means 40 of the lower section 22. The water sprinkler system 10 is now ready for operational use in water spraying 14 of lawns 18, bushes, shrubs, and the like. The user then turns on the water 14 at the water source, and a high pressure surge of water 14 flows through the water hose 16, the central water column assembly 20 and sprinkler head 12. This high pressure surge or reaction force ($F_R$) does not overturn the water sprinkler system 10 because the upper and lower inner plastic PVC tubes 54 and 30, respectively, are rotationally movable in a 120° arc with respect to the tripod assembly 70 which remains fixed and stationary as the water reaction forces ($F_R$) tend to rotate tubes 54 and 30.

When the user is finished with the operational use of water sprinkler system 10, he/she simply shuts off the water source, disconnects the water hose 16 from the hose connection means 40, disconnects the upper plastic tube 54 from the lower plastic tube 30, then unbolts the upper leg members 84*a* to 84*c* from each of the foot members 134*a* to 134*c*, respectively, and collapses the upper and lower leg members 84*a* to 84*c* and 114*a* to 114*c* inwardly towards the first and second outer tubes 24 and 44, respectively. The user then places the upper plastic tube 54 adjacent to the collapsed tripod assembly 70 and wraps a Velcro™ strap 140 around both entities to secure them for ease of carrying, portability and storage, as shown in FIG. 4 of the drawings. Alternatively, if one wishes to store sprinkler system 10 in a standing position, then it is not necessary to unbolt upper leg members 84*a* to 84*c*.

ADVANTAGES OF THE PRESENT INVENTION

Accordingly, an advantage of the present invention is that it provides for a sprinkler system of simple design, durability and sturdiness having a tripod assembly with feet for increased ground stability; and a central water column assembly being rotatable relative to the tripod assembly for ease of water hose connecting and orientation.

Another advantage of the present invention is that it provides for a sprinkler system which has a structure and design configuration that substantially eliminates the "kick" or reaction forces resulting from water being ejected from the sprinkler head, such that the sprinkler system is not subject to being overturned by the reaction forces of the water.

Another advantage of the present invention is that it provides for a sprinkler system that has substantially eliminated the "kick" being transmitted to the tripod assembly by allowing the central water column assembly to be rotationally movable relative to the tripod assembly in order to prevent any overturning of the sprinkler system when in use.

Another advantage of the present invention is that it provides for a sprinkler system that is of lightweight design and simple structural configuration for easy setup for water spraying of lawns, gardens, flowers, shrubs, orchards, and trees.

Another advantage of the present invention is that it provides for a sprinkler system that is foldable into a compact, lightweight and portable configuration for easy carrying and storage by the user without removing any bolts or nuts.

Another advantage of the present invention is that it provides for a sprinkler system made of galvanized steel and PVC plastic components for increased operational use and service life of the sprinkler system without undue maintenance and operational costs.

Another advantage of the present invention is that it provides for a sprinkler system that is capable of water spraying an area that covers up to 5,000 square feet.

A further advantage of the present invention is that it provides for a water sprinkler system that can be mass produced in an automated and economical manner and is readily affordable by the user.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A portable sprinkler system, comprising:

a) A central column assembly including a lower section, an upper section removably connected to said lower section, and a sprinkler head removably connected to said upper section;

b) said lower section includes an outer tube formed of galvanized steel, an inner tube formed of plastic for supplying water to said upper section, and hose connection means at said lower end for receiving a hose for supplying water to said inner tube;

c) said upper section being formed of plastic and being removably connected to said inner tube of said lower section to form a rotatable column, said upper section including means for removably connecting said sprinkler head thereto so that said rotatable column and said sprinkler head are rotatable as a unit relative to said outer tube in response to reaction forces produced by said sprinkler head;

d) said outer tube at the lower end thereof having three connection flanges formed of galvanized steel extending outwardly from said outer tube;

e) first, second, and third leg members formed of galvanized steel tubing each having an open seam and being pivotally connected at their upper ends to receive said three connection flanges on said outer tube in each of said open seams, respectively;

f) first, second, and third horizontally disposed feet members for engaging the ground to support said sprinkler system being connected to the lower ends of said first, second, and third leg members, respectively;

g) said lower section including a second outer tube formed of galvanized steel and being slidably disposed on said inner tube, said second outer tube having three connection flanges formed of galvanized steel extending outwardly from said second outer tube;

h) fourth, fifth, and sixth leg members formed of galvanized steel tubing each having an open seam and being pivotally connected at their upper ends to receive said three connection flanges on said second outer tube in each of said open seams, respectively;

i) said first, second, and third feet members being connected to the lower ends of said fourth, fifth, and sixth leg members, respectively; and j) said first to sixth leg members being movable between a first position parallel to said central column assembly when said sprinkler system is not in use and a second position diagonally disposed relative to said central column assembly when said sprinkler system is in use to support said central column assembly in a vertical position.

2. A sprinkler system in accordance with claim 1, wherein the upper ends of said first to sixth leg members are cut at an angle to engage said outer tube and said second outer tube of said lower section when said leg members are in their second position diagonally disposed relative to said central column.

3. A sprinkler system in accordance with claim 1, wherein the open seams at the upper ends of said first to sixth leg members receive said six connection flanges, respectively, and wherein said flanges are each connected by only one bolt to said upper ends of said first to sixth leg members.

4. A sprinkler system in accordance with claim 1, wherein the lower ends of said first to third leg members are connected to said three feet members, respectively, each by only one bolt, and wherein the lower ends of said fourth to sixth leg members are also connected to said three feet members, respectively, each by only one bolt.

* * * * *